US005145592A

United States Patent [19]

Caporiccio

[11] Patent Number: 5,145,592

[45] Date of Patent: Sep. 8, 1992

[54] NEUTRAL HYDROGEN-FREE FLUOROCARBON COTELOMERS

[75] Inventor: Gerardo Caporiccio, Midland, Mich.

[73] Assignee: Dow Corning Corporation, Midland, Mich.

[21] Appl. No.: 628,053

[22] Filed: Dec. 17, 1990

[51] Int. Cl.[5] ..... C10M 131/10; C10M 131/04

[52] U.S. Cl. ..... 252/54; 252/58; 252/77; 568/615; 570/125; 570/138

[58] Field of Search ..... 568/615; 570/125, 138; 252/54, 58, 77

[56] References Cited

U.S. PATENT DOCUMENTS

| | | | |
|---|---|---|---|
| 2,770,659 | 11/1956 | Barnhart | 260/653 |
| 3,091,648 | 5/1963 | Hauptschein et al. | 260/653.1 |
| 3,219,712 | 11/1965 | Hauptschein et al. | 260/653.1 |
| 3,992,931 | 9/1961 | Hauptschein et al. | 260/653.1 |

FOREIGN PATENT DOCUMENTS

| | | |
|---|---|---|
| 0473113 | 4/1951 | Canada . |
| 0321990 | 12/1988 | European Pat. Off. . |

*Primary Examiner*—Ellen McAvoy

*Attorney, Agent, or Firm*—Robert Spector

[57] ABSTRACT

A class of neutral, hydrogen-free liquid or waxy perfluorinated cotelomers is described. The cotelomers contain more than 50% weight of fluorine and are derived from chlorotrifluoroethylene and a member selected from the group consisting of one perfluorinated olefin, one perfluorinated alkylvinyl or polyoxaalkylvinyl ether, where said alkyl radical contains from 1 to 6 carbon atoms and said polyoxaalkyl group contains from 2 to 10 carbon atoms; mixtures of two perfluorinated olefins containing from 2 to 6 carbon atoms, with the proviso that one is tetrafluoroethylene, and a mixture of tetrafluoroethylene with one of said perfluorinated alkylvinyl ethers. The present cotelomers exhibit excellent lubricity, transparency, low compressibility, low refractive index and a high resistance to electrical discharge. The cotelomers are particularly useful as lubricants and hydraulic fluids, as optical media and as insulating materials. Methods for preparing the cotelomers and for stabilizing the cotelomers to further improve their thermal and oxidative stability are also described.

8 Claims, No Drawings

NEUTRAL HYDROGEN-FREE FLUOROCARBON COTELOMERS

BACKGROUND OF THE INVENTION

1. Field of the Invention

This invention relates to novel fluorocarbon compounds. More particularly, this invention relates to liquid or waxy cotelomers of chlorotrifluoroethylene and selected perfluorinated ethylenically unsaturated organic compounds, and to a method for stabilizing these cotelomers to yield liquid or waxy materials exhibiting combinations of desirable chemical, thermal and electrical properties that are lacking in many prior art fluorinated telomers and cotelomers of chlorotrifluoroethylene.

2. Description of the Prior Art

The use of chlorotrifluoroethylene telomers as lubricants is disclosed in many patents, such as U.S. Pat. No. 2,770,659. The use of these telomers as hydraulic fluids is also known. The cotelomerization of fluoroolefins is also reported in many patents and papers, e.g., U.S. Pat. Nos. 3,002,031; 3,091,648 and 3,219,712, European Patent Office Publication No. 321,990 and the text "Free Radical Telomerization" by C. M. Starks, published by the Academic Press in 1974.

Specifically, copolymers of chlorotrifluoroethylene and vinylidene fluoride or of tetrafluoroethylene and hexafluoropropene are also disclosed in the prior art.

Irregularities in the orientation of repeating units in telomers derived from chlorotrifluoroethylene, referred to hereinafter as CTFE, results in the presence of chlorine atoms on adjacent carbon atoms. These "tail-to-tail" sequences can occur in 5 to 10% of the repeating units when the temperature of the telomerization exceeds about 120° C. or when some other severe conditions of activation are used to promote the telomerization. The presence of these tail-to tail sequences is believed responsible for the relatively poor thermal stability of these telomers in the presence of oxygen and metals such as iron and its alloys, zinc and aluminum, and the limited capability of these telomers to function effectively and safely as lubricants at high temperatures. These disadvantages are considered due primarily to the ease with which these telomers undergo metal-catalyzed dechlorination of =ClC—CCl= groups or to the presence of labile terminal groups such as $CFCl_2$ that initiate corrosion of the metal.

The decomposition of the telomers is accelerated in the presence of overheated metal surfaces that frequently occur in rotating or reciprocating mechanical devices. The presence of oxygen and water can accelerate the chloride-initiated corrosion of metal. These disadvantages of liquid telomers derived from CTFE have considerably limited the industrial application of these materials.

An objective of this invention is to provide a class of fluorocarbon cotelomers that does not exhibit the aforementioned disadvantages of prior art telomers of chlorotrifluoroethylene.

A second objective of this invention is to provide thermally stable, chemically inert and hydrogen-free cotelomers containing at least 50 weight percent of fluorine and additional elements limited to carbon, chlorine and oxygen.

Another objective of this invention is to provide a method for stabilizing cotelomers of CTFE against heat-induced degradation.

SUMMARY OF THE INVENTION

The objective of this invention is achieved by providing thermochemically stable cotelomers of chlorotrifluoroethylene and a specified class of perfluorinated organic monomers and a method for stabilizing these cotelomers. The cotelomers of this invention contain units derived from CTFE in combination with terminal and/or non-terminal units derived from a specified group of perfluorinated, ethylenically unsaturated fluorocarbons and ethers containing only carbon, oxygen and fluorine. The presence of hydrogen atoms in the present telomers is specifically excluded.

The present cotelomers are derived from combinations of chlorotrifluoroethylene (CTFE) with one perfluoroolefin, one perfluorinated alkylvinyl ether or perfluorinated polyoxaalkylvinyl ether, two perfluoroolefins or the combination of one perfluoroolefin and one perfluorinated alkylvinyl ether. The cotelomers are waxes or liquids under ambient conditions, and exhibit high thermochemical stability, particularly in the presence of metals, oxygen and water, a high degree of lubricity, a compressibility approaching that of hydrocarbon-based hydraulic fluids, excellent electrical insulating properties and a low refractive index.

The properties of the present cotelomers are due to 1) the sequence and configuration of repeating units and 1) the method for stabilizing these cotelomers by fluorination.

DETAILED DESCRIPTION OF THE INVENTION

This invention provides unreactive, neutral and hydrogen-free cotelomers in the form of a liquid or a wax, said cotelomers consisting essentially of perfluorinated carbon atoms at the terminal positions and repeating units derived from chlorotrifluoroethylene and a member selected from the group consisting of:

(a) one perfluorinated olefin containing from two to six carbon atoms;

(b) one perfluorinated alkylvinyl ether, where said alkyl radical contains from 1 to 6 carbon atoms;

(c) one perfluorinated polyoxaalkylvinyl ether, where said polyoxaalkyl radical contains from two to ten carbon atoms and from one to three oxygen atoms exclusive of the oxygen linkage to said vinyl radical;

(d) mixtures of two perfluorinated olefins containing from 2 to 6 carbon atoms with the proviso that one of said two olefins is tetrafluoroethylene;

(e) mixtures of tetrafluoroethylene with one of said perfluorinated polyoxaalkylvinyl ethers; and (f) mixtures of tetrafluoroethylene with one of said perfluorinated polyoxaalkylvinyl ethers where units derived from chlorotrifluoroethylene constitute up to 95 percent of the units present in said cotelomer and said cotelomer is substantially free of chlorine atoms located on adjacent carbon atoms.

This invention also provides a preferred method for preparing the present cotelomers. The method comprises the steps of:

A. forming a cotelomer consisting essentially of units derived from chlorotrifluoroethylene and a member selected from the group consisting of (1) one perfluorinated olefin containing from 3 to 6 carbon atoms, (2) one perfluorinated alkylvinyl or polyoxaalkyl vinyl ether, wherein said alkyl radical contains from 1 to 6 carbon atoms and said polyoxaalkyl radical contains from 2 to 10 carbon atoms, and (3) mixtures of two perfluorinated olefins containing from 2 to 6 carbon atoms with the proviso that one of said olefins is tetrafluoroethylene, and (4) mixtures of tetrafluoroethylene and one of said perfluorinated alkylvinyl ethers or polyoxaalkylvinyl ethers; and B. forming a stabilized cotelomer by reacting a 5-30% by volume solution of said cotelomer in a liquid chlorofluorocarbon with a gas stream containing 5-60 volume percent of fluorine diluted with nitrogen and maintaining said solution at a temperature of from −20° to +30° C. to form a solution containing said stabilized cotelomer, C. preheating said stabilized cotelomer (A) to a temperature of 135° C. prior to passing said stabilized cotelomer through a tube having a length/diameter ratio of 20 and filled with activated zinc scraps that are maintained at a temperature of from 100° to 150° C., the residence time of said cotelomer A in said tube being from 10 to 60 minutes, to form cotelomer B, D. exhaustively fluorinating said cotelomer B by reacting it with a gas stream containing from 20 to 60 volume percent of fluorine diluted with nitrogen at a temperature of from 50° to 175° C. in a nickel reactor and in the presence of $KCoF_4$ or $CoF_3$ as a filler while maintaining the temperature of the reaction mixture between 100° and 175° C. to form cotelomer C, and E. isolating said stabilized cotelomer C from said solution.

The present cotelomers are obtained by a radical-initiated cotelomerization of a mixture of chlorotrifluoroethylene with a) one or two perfluorinated olefins as described in the preceding section of this specification, or b) with one perfluorinated alkylvinyl- or polyoxaalkylvinyl ether, where any perfluoroalkyl portion of an ether contains from 1 to 6 carbon atoms and any perfluorinated polyoxaalkyl portion of an ether contains from 2 to 10 carbon atoms and from one to three oxygen atoms, exclusive of the oxygen linkage to the vinyl radical of said ether, or c) with a mixture of said perfluorinated alkylvinyl- or polyoxaalkylvinyl ether and tetrafluoroethylene. The preferred perfluorinated olefins under (a) above are tetrafluoroethylene (TFE) and hexafluoropropene (HFP).

Alternatively, the cotelomer chain can be prepared by first reacting chlorotrifluoroethylene with the telogen followed by reaction of the resultant telomer with the desired comonomer(s) in an endcapping or sequential reaction.

The perfluorinated alkyl vinyl ethers used to prepare the present cotelomers contain one or two ether groups and the perfluorinated polyoxaalkylvinyl ethers contain 2 or 3 oxygen ether groups. Preferred perfluorinated alkylvinyl- and polyoxaalkylvinyl ethers include but are not limited to perfluoromethylvinyl ether (PFMVE), perfluoroethylvinyl ether (PFEVE), perfluoropropylvinyl ether (PFPVE) and perfluoro-2-methyl-3-oxahexylvinyl ether.

The (co)teleomerization of CTFE can be initiated by bromo- or iodo-substituted telogens represented by the formula $R_fX$ or $XR_f'X$, where $R_f$ represents a perfluoroalkyl radical containing from 1 to about 4 carbon atoms, $R_f'$ is a perfluoroalkyl radical containing from 1 to 6 carbon atoms, Rf' represents a perfluoroalkylene radical containing from 2 to 6 carbon atoms and X is bromine or iodine, preferably iodine. Moreover, one of the fluorine atoms of $R_f$ or $R_f'$ can be replaced with chlorine, with the proviso that chlorine and X are on the same carbon atom. Suitable telogens include but are not limited to $CF_3I$, $C_2F_5I$, n-or iso-$C_3F_7I$, n-$C_4F_9I$, $CF_3CFBrCF_2Br$, $CF_2BrCFClBr$, $CF_2ICF_2I$, and $I(C_2F_4)_tI$, where the value of t is 2 or 3, $CF_2BrCClFI$ and $C_3F_6BrI$, the last two telogens being derived from the addition of BrI to chlorotrifluoroethylene and hexafluoropropene, respectively.

The reaction between the telogen, CTFE and any additional perfluorinated monomers to prepare the initial telomer is initiated by free radicals that can be generated by heating, preferably in the presence of an organic peroxide, the (co)telomerization can also be initiated by exposure to radiation such as gamma-rays or ultra-violet light, by redox systems that include mercury, copper or iron salts and amines or other reducing agents, metal carbonyls derived from elements in groups VI, VII and VIII of the Periodic Table of Elements, trialkyl boron compounds and the addition of stoichiometric amounts of oxygen.

Preferred catalysts/initiators for the initial telomerization include ultraviolet light, benzoyl peroxide, di-t-butyl peroxide, t-butylperoxypivalate, t-butylperoxyisopropyl carbonate and bis(4-t-butylcyclohexyl)peroxy dicarbonate. Preferred redox catalysts contain as one of the ingredients a mercury, copper or iron compound.

The telomerization can be conducted in the presence of organic solvents including but not limited to 1,1,2-trichlorotrifluoroethane, t-butyl alcohol, acetonitrile, dimethyl sulfoxide, and mixtures containing two or more of these solvents. The temperature of the telomerization reaction can range from ambient to 150° C. if the reaction is initiated by irradiation or catalysts, or from 150° to 220° C. if the reaction is thermally initiated.

The pressure under which the telomerization is conducted can range from ambient up to about 100 atmospheres. As with other free radical-initiated reactions, oxygen should be excluded from the reaction mixture.

Units derived from chlorotrifluorethylene constitute up to 95 percent of the repeating units of the present cotelomers. This value is preferably at least 70 mole percent, based on economic considerations and the feasibility of preparing the cotelomers. This preference is due to the decrease in the rate of telomerization that is observed as the number of carbon atoms in the comonomer is increased above 2. This preference is also based on the relatively high cost of perfluorinated alkylvinyl ethers.

Because a majority of the repeating units in the present cotelomers are derived from $C_2ClF_3$, to avoid possible dehalogenation or dehydrohalogenation, the telomerization process, including selection of comonomers, and the chain terminating process must be conducted in a manner that will completely avoid or at least minimize the sequences =ClC—CCl=.

One or two perfluoroolefins, one perfluorinated alkylvinyl or polyoxaalkylvinyl ether or one of the mixtures of tetrafluoroethylene and fluorinated alkylvinyl- or polyoxaalkylvinyl ethers described in this specification is reacted with CTFE or a telomer of CTFE to prepare the initial cotelomers that are subsequently stabilized by fluorination.

Perfluorinated alkylvinyl ethers can be prepared by the decarboxylation of either polyoxaperfluoroalkanoyl fluorides or perfluoro-2-methyl-2 methoxy acetyl fluoride.

Preferred systems of monomers for use in preparing the present cotelomers include but are not limited to:

1) Chlorotrifluoroethylene (CTFE) and hexafluoropropene (HFP);
2) CTFE, HFP and tetrafluoroethylene (TFE);
3) CTFE and perfluoromethylvinyl ether (PFMVE); and
4) CTFE and TFE and PFMVE.

The telomerization of CTFE alone or in combination with one or more additional monomers of this invention can be carried out in the absence of solvent or the reaction medium can include at least one solvent. Examples of suitable solvents include but are not limited to Freon® 113 (1,1,2-trichlorotrifluoroethane), t-butyl alcohol and mixtures of this alcohol and Freon® 113.

The sequence of alternating repeating units in the cotelomers, the conditions for initiating the cotelomerization in the presence of very active catalysts and/or promoting agents and an adequate concentration of comonomers are useful methods for avoiding or at least minimizing the "tail-to-tail" sequences of CTFE units, resulting in the presence of chlorine on adjacent carbon atoms. This sequence is undesirable because of its instability when in contact with metal surfaces, such as iron and alloys or other metals like aluminum or zinc. The instability is believed to result from dechlorination of said group, resulting in corrosion of metals, particularly in the presence of oxygen and water.

When TFE, HFP or PFMVE is present together with CTFE in the initial reaction mixture, the rate of reaction of CTFE with these comonomers is believed to be competitive with the rate of reaction of CTFE to form a tail-to-tail sequence —CFCl—CFCl—, with the result that these undesirable CTFE sequences have been eliminated or at least minimized.

When CTFE is the only monomer present during the initial telomerization reaction, the initial telomer must be end-capped by reaction with hexafluoropropene, tetrafluoroethylene, or a perfluorinated alkylvinyl ether. This endcapping procedure ensures that the final telomer obtained following the stabilization step will not contain chlorine as a substituent on the terminal carbon atoms.

Cotelomers that still contain a terminal iodine atoms following endcapping with tetrafluoroethylene atom can be readily chain extended using, e.g., the procedure described by R. Haszeldine in *Journal Chemical Soc.* (London) 1953, page 1592 and in U.S. Pat. No. 3,840,403. One of these procedures employs ultraviolet irradiation and a mercury induced coupling of iodo-terminated cotelomers that had been previously end-capped with perfluoroolefins, preferably TFE, in order to avoid thermally unstable groups of the structure ClC-CCl during the coupling.

An alternative route for chain extending iodo- or bromo-terminated cotelomers that had previously been end-capped using TFE involves a coupling reaction in the presence of copper or systems containing zinc and copper. This reaction can optionally be carried out in the presence of solvents such as dimethylformamide, tetrahydrofuran or dimethylsulfoxide using some of the procedures described in U.S. Pat. No. 4,634,797; or by D. J. Burton at the Santa Cruz International Fluorine Conference (August, 1988, summarized in Chemical Abstracts).

Without further elaboration it is believed that one skilled in the art, using the methods described in this specification can utilize the present invention to its fullest extent. The following preparations and Examples are, therefore, to be construed as merely illustrative, and not limitative in any way whatsoever, of the remainder of the disclosure or claims. The preparations and Examples, while they have not actually been carried out, describe preparative methods that are expected to yield preferred embodiments of the present invention.

STABILIZATION OF THE PRESENT COTELOMERS

Although the present methods for cotelomerization of CTFE with the perfluorinated monomers described in this specification are designed to avoid formation of unstable =CCl—CCl= sequences along the chain, the invention includes submitting the initial cotelomers to a process of stabilization organized in three successive steps in order to eliminate all the traces of unstable groups that can be present and to arrive at the most stable structures of the cotelomers of CTFE.

Cotelomers obtained according to the present methods are stabilized using the following procedure:

Step 1) A cotelomer (A) as a 5–30% by volume solution in a perhalogenated solvent such as 1,1,2-trichlorotrifluoroethylene is placed in a glass lined reactor while a gas stream containing 5–60 volume % of fluorine diluted with nitrogen is bubbled through the solution while it is maintained at a temperature of from −20° to +30° C. This step converts the initial terminal bromine or iodine atoms to fluorine atoms (cotelomer B).

The following second and third steps of the purification process can be omitted if analytical data, such as $^{19}F$ nuclear magnetic resonance spectra, indicate that the telomer is of sufficient purity and sufficiently free of structural irregularities, particularly adjacent chlorine-substituted carbon atoms, as to make the cotelomers suitable for their intended end use.

Step 2) Following removal of solvent, cotelomer B is passed through an iron tube having a length/diameter ratio of 20. The tube is filled with zinc scraps that are activated beforehand by washing them in a 15 weight percent aqueous solution of hydrochloric acid, then in water and are them dried under reduced pressure at 100° C. The tube is maintained at a temperature of from 100° to 150° C., preferably at 135° C., cotelomer B is preheated to 135° C., and the residence time of the cotelomer in the tube is from 10 to 60 minutes, preferably 30 minutes, to form a product C.

The first two steps of the procedure decompose any thermally unstable units or structural irregularities in the cotelomer molecules, such as the undesirable sequences of ClC—CCl and the groups —$P_F$X, where X is iodine or bromine and $P_F$ is the cotelomer chain, that have been formed during the cotelomerization process.

Step 3) Product C is exhaustively fluorinated by reacting it at temperatures from 50° to 175° C. with a gas stream containing from 20 to 60 volume percent of fluorine diluted with nitrogen in a nickel reactor to form a product D. In an alternative process, product C is reacted with the diluted fluorine stream in the presence of $KCoF_4$ or $CoF_3$ as a filler and the temperature of the reaction is from 100° to 175° C. In either case, a stream of nitrogen is bubbled through the resultant product D while it is maintained at a temperature of 50° C. The reaction product is then filtered through a submicron Millipore (R) filter and fractionated by distillation.

Following stabilization the present cotelomers exhibit low values of surface energy, that are typically in the range of from 28–20 dynes/cm, depending upon their content of units derived from perfluoro vinyl compounds. The low surface energy imparts excellent wetability power, a low coefficient of friction and high hydrophobicity, with the result that the present cotelomers are very good lubricants and able to resist attack by chemically aggressive agents in aqueous media.

The sequences of component units in the present stabilized fluorinated cotelomers and the presence of pendant alkyl or alkoxy groups in some of these products contributes to the favorable low temperature rheology and low pour point of the cotelomers. These properties will vary somewhat depending on the average molecular weight, the polydispersity of the cotelomers and the structure of the cotelomer chain.

Other desirable properties of the present cotelomers include but are not limited to:

low dielectric constant, from 2 to 3 under ambient conditions low refractive index (lower than $n_d=1.41$ at 25° C.)

high resistance to solvents, aggressive chemicals and to metals, particularly at temperatures above 175° C.

non-flammability good viscostaticity

End use applications for the liquid telomers of this invention include lubricants (oils and bases for greases), hydraulic fluids, insulating fluids for electrical applications, barrier and release materials, light transmitting materials in optical devices.

Cotelomers exhibiting the desired range of viscosities and of molecular weight range can used as bases for greases in combination with thickeners such as polymers and copolymers of tetrafluoroethylene. When used as hydraulic fluids, the non-flammable nature of the copolymers allows them to be used under severe conditions of high temperature and pressure (over 135° C. at pressure of over 4000 psi).

The following examples describe preferred embodiments of the present hydrogen-free cotelomers, preparative methods and intermediates for preparing the present telomers. The examples should not be interpreted as limiting the scope of the invention defined in the accompanying claims. Unless otherwise indicated all parts and percentages in the examples are by weight and viscosities were measured at 25° C.

EXAMPLES 1–4

These examples describe the preparation and fluorination of telomers containing units derived from chlorotrifluoroethylene (CTFE) or CTFE and hexafluoropropene (HFP) and the fluorination of these telomers.

Individual glass polymerization tubes were charged with the telogen(s) listed in Table 1 under an inert atmosphere, followed by distillation into the tube of the fluoroolefin(s) under reduced pressure. The tubes were then sealed and reacted as reported in Table 1.

At the end of the reaction period the tubes were opened, the volatile materials evaporated, the telogen removed by distillation and the residual telomeric products analyzed by $^{19}F$ NMR spectroscopy.

The telomeric product of Example 3 contained a fraction that by $^{19}F$ NMR analysis was shown to have a molar ratio of CTFE to HFP of at least 5:1 respectively. The signal maxima in the range from −69.2 to −70 ppm were present only when the telomerization was run in the presence of HFP monomer, (Table 1). The maxima became more intense as the relative concentration of HFP in the monomer mixture was increased; in addition, these NMR absorption maxima did not disappear or decrease in intensity after fluorination of the product as reported hereinafter. Additional maxima present in the region from −137 to −144 ppm are indicative of HFP units; and maxima present in the region from −175 to −185 ppm were indicative of any tertiary —CF(CF$_3$)— group.

The absence of an absorption maximum in the region of −123 ppm in the NMR spectrum indicated the absence of CFCl—CFCl sequences in the telomer product. The average structure assigned to this telomer fraction (3A) on the basis of the NMR data was $(CF_3)_2CF[(C_2F_3CCl)_m(C_3F_6)_n]I$, where m/n has a minimum value of 6.5 and the majority (65–75%) of the units derived from HFP are located at the ends of the telomer chains.

Six parts of the telomer mixture 3A, dissolved in 60 parts of 1,1,2-trichlorotrifluoroethane (Freon(R) 113), were placed in a glass tube and maintained at −20° C. while a slow flow of fluorine diluted with an equal volume of nitrogen was bubbled through the mixture for 60 hours. At the end of this period the solvent was removed by distillation, leaving 5 parts of an oil-wax mixture. The $^{19}F$ NMR spectrum of the oil exhibited the maxima reported in Table 1. Specifically, the maxima in the range from −69.2 to −71 ppm were retained at the same relative intensity present in the telomer prior to the fluorination step, and all of the maxima attributable to the iodofluorocarbon group were no longer present. On the basis of the NMR spectrum the structure assigned to the fluorinated product (3B) was:

$$(CF_3)_2CF[(C_2F_3Cl)_m(C_3F_6)_n]F \quad (3B)$$

where the average ratio m/n resulted about at 7:1 by NMR and where the terminal groups were —$C_3F_7$ with only a minor concentration of —$CF_2Cl$ units.

The refractive index of 3B, measured at 20° C., was 1.3765.

TABLE 1

| | Ex. 1* | Ex. 2 | Ex. 3 | Ex. 4 |
|---|---|---|---|---|
| Molar parts | | | | |
| i-$C_3F_7I$ | 4 | 5.9 | 2.66 | — |
| CTFE | 2.32 | 4.65 | 0.95 | — |
| HFP | — | 3.6 | 2.86 | — |
| Fluorination | — | — | — | Product from Ex. 3 |
| Telomerization Conditions | | | | |
| Temp (°C.) | 220 | 90 | 220 | — |
| Time (hrs.) | 48 | 96 | 16 | — |

TABLE 1-continued

| | | Ex. 1* | Ex. 2 | Ex. 3 | Ex. 4 |
|---|---|---|---|---|---|
| Initiator | | — | U.V. | — | — |
| Analysis by $^{19}F$ NMR | | | | | |
| ppm $CFCl_3$ St'd. | Groups | | | | |
| −53 to −60 | $\underline{CF_2}I$ | + | + | + | abs. |
| −65 to −68 | $\underline{CF}ClI$ | + | + | abs. | abs. |
| −69.2 to −70 | Relative intensity increasing with HFP monomer conc. | abs. | + (small) | ++ | ++ |
| −71.7 to −72.4 | $(\underline{CF_3})_2CFCF_2—CFCl$ | strong | strong | strong | strong |
| −122 to −124 | $\underline{CF}Cl—CFCl$ | v. small | abs. | abs. | abs. |
| −137 to −144 | $—(CF_3)\underline{CF}I$ | abs. | + | + | abs. |
| −175 to −185 | $—\underline{CF}(CF_3)—$ | + | ++ | ++ | ++ |

*Example 1 is not within the scope of the present invention, but is included to demonstrate the absence in this telomer of the NMR maxima −69.2 to −70 and −137 to −144) associated with the presence of HFP monomer. To the contrary, example 1 shows the presence of tail-to-tail sequences of the CTFE units (−122.5 to 124 ppm) at a concentration equivalent to about 5% of the total CTFE content of the telomer.

EXAMPLE 5

Preparation of a Telomer of Chlorotrifluoroethylene Endcapped with Hexafluoropropene

Telomerization of Chlorotrifluoroethylene

A glass polymerization tube was evacuated and then charged by reduced pressure distillation with trifluoromethyl iodide and chlorotrifluoroethylene in a molar ration of 5:1, respectively. The tube was then sealed and exposed to the radiation from a 1000 watt ultraviolet lamp for 4 days at a distance of 5 cm. from and oriented parallel with respect to the lamp. The tube was then opened, the gases vented and the residual liquid analyzed using gas/liquid chromatography.

A comparison of the retention times of the residual liquid with those of other telomers indicated the product to be composed of three telomers of the general formula $CF_3(CF_2CFCl)_nI$ (5A) where n was 1, 2 and 3. The relative areas under the three major peaks of the chromatogram indicated a molar ratio for the n=1, n=2 and n=3 telomers of 5:1.5:1, respectively.

Reaction of Telomer (A) with Hexafluoropropene

A 250 ml-capacity stainless steel autoclave was charged with the telomer A prepared as described in the first part of this example. The autoclave was then sealed and hexafluoropropene was distilled in under reduced pressure. The amount of hexafluoropropene added was equivalent to a molar ratio of initial telomer to hexafluoropropene of 1:6. The autoclave was then heated at 200° C. and rocked for 86 hours. After the unreacted gases had been discharged the residual liquid was analyzed using gas/liquid chromatography, with an SE column and a heating program of 15° C. per minute to a final temperature of 270° C. The longer retention times of the final products relative to the initial telomers indicated that all had reacted to form endcapped telomers.

Analysis of the final products using 60 MHz NMR supported the proposed structure $CF_3[CF_2CFCl]_r[CF_2CF(CF_3)]_qI$ (Telomer 5B) where r=1, 2 and 3 and q=1, with a smaller amount of product with q=2. This structure was further supported by isolating a fraction wherein r and q of the preceding general formula were each 1 using preparative liquid/-gas chromatography and analyzing this fraction using $^{19}F$ NMR. The shifts (in ppm using trichlorofluoromethane as the standard) assigned to the various groups were as follows:

| Shift | Group |
|---|---|
| −72.5 | $—CF_3(C_3F_6)$ |
| −78.9 | $—CF_3$ (terminal group from the telogen) |
| −97.9 to −109.5 and −118.6 to −119.4 | $—CF_2—$ |
| −126 to −134 | —CFCl— |
| −140 to −144 | tert-CF = from $C_3F_6$ |

There were no signals attributable to the CFClI group.

EXAMPLES 6–13

These examples describe additional telomerization procedures useful for preparing telomers of chlorotrifluoroethylene that can be converted to intermediate cotelomers of the present invention by sequential reaction of the telogen with suitable monomers followed by the endcapping procedure described in example 5 of the present specification and subsequently fluorinated using the procedure described in Example 1. The telomers prepared are summarized in the following Table 2.

In Table 2 the molar ratio of telogen to chlorotrifluoroethylene is represented as T/CTFE, the conditions under which the telomerization was conducted are listed under the heading "Rxn. Conditions" and n represents the average number or range of monomer units per molecule of telomer.

TABLE 2

| Ex. | Telogen | T/CTFE (molar ratio) | Rxn. Catalyst | Conditions | n |
|---|---|---|---|---|---|
| 6 | $i\text{-}C_3F_7I$ | 1:0.35 | BP | 85° C./46 Hrs. | 6.9 |
| 7 | $CF_3I$ | 5:1 | — | UV/16 Hrs./RT | 1,2 |
| 8 | Product of Ex. 7 | 3:2 (WR) | T BCPD | 60° C./4 Hrs. | 1-5 |
| 9 | $CF_2ClBr$ | 5:1 | Mixture | 70° C./13 Hrs. | 1-5 |
| 10 | $C_4F_9I$ | 5:1 | $HgI_2$/AN | 150° C./48 Hrs. | 1 |
| 11 | $C_4F_9I$ | 1:1 | $HgCl_2$/AN | 150° C./48 Hrs. | 1-5 |
| 12 | $C_4F_9I$ | 1:1 | CuI/AN | 150° C./48 Hrs. | 1-5 |
| 13 | $CF_3I$ | 9:1 | T BCPD/ FR | 60° C./16 Hrs. | 1-2 |

BP=Benzoyl Peroxide, 2 mol % based on CTFE
WR=Weight Ratio

UV = Radiation from 1000 watt mercury vapor lamp, distance = 5 cm.
RT = Room Temperature
T BCPD = bis-4-t-butylcyclohexylperoxy dicarbonate, 10% based on CTFE
Mixture = t-butyl peroxypervalate:benzoyl peroxide:di-t-butyl peroxide (4.6:06:0.6% mole based on CTFE)
AN = Acetonitrile, equal to weight of telogen
Concentration of $HgI_2$ = 19%, weight based on CTFE
Concentration of $HgCl_2$ = 4%, weight based on CTFE
Concentration of CuI = 1.5%, weight based on CTFE
FR = Freon(R) 113, 74%, weight based on telogen

EXAMPLE 14

CTFE Telomers Prepared Using 1-Bromo-2-chloro-2-iodotrifluoroethane ($BrCF_2CFClI$) as Telogen and Fluorination Thereof A glass tube was charged under flushed nitrogen with 0.4 parts weight of bis(4-t-butylcyclohexylperoxy dicarbonate), 16.9 parts of $BrCF_2CFClI$ and 5.1 parts weight of CTFE. The tube was sealed and heated at 65° C. for 16 hours. The tube was then cooled to −80° C. prior to being opened. The unreacted olefin was allowed to evaporate and the telogen was then distilled to obtain as residue 6.9 parts of telomer. The $^{19}F$ NMR spectrum of the telomer exhibited signals (ppm, $CFCl_3$ standard) assigned to the following groups:

| | |
|---|---|
| −56–60 | $-CF_2Br$ |
| −97–103 and 65–68 | $-\underline{CF_2}CFClI$ |

On this basis the average structure $Br(C_2F_3Cl)_nI$ was assigned to the telomer, where the average n was about 4.

Analysis of the telomers using gas-liquid chromatography with a SE-30 column indicated a molar ratio of 1.7:1 for the telomers $Br(CF_2CFCl)_nI$ with n = 2 and n = 3, respectively.

This telomer can be endcapped with hexafluoropropene (HFP) using the procedure described in Example 5 and fluorinated using the following procedure.

5 parts of the CTFE telomer mixture, dissolved in 60 parts of 1,1,2-trichlorotrifluoroethane, were introduced in a glass tube that was maintained at −20° C. for 32 hours while a gas stream containing equal volumes of fluorine and nitrogen was bubbled through the solution for 32 hours. The $^{19}F$ NMR spectrum obtained following evaporation of the solvent contained signal maxima interpreted as representing the following groups (ppm, $CFCl_3$ standard):

| Shift (ppm) | Group |
|---|---|
| −77 to −78 | $CF_3$ |
| −132 to −136 | $CF_3CFCl$ |
| −105 to −115 and | $CF_2—CF_2Cl$ |

-continued

| Shift (ppm) | Group |
|---|---|
| −65 to −66 | |

The spectrum did not have measurable maxima assignable to the CFCl—CFCl group.

EXAMPLES 15 AND 16

Telechelic Telomers Containing CTFE and HFP Units

Individual glass polymerization tubes were charged with the monomers and telogens in Table 3 under an inert atmosphere. The tubes were then sealed and exposed to the irradiation from a 1000 watt Hanovia (R) medium pressure mercury lamp for 3 days. At the end of this time period the tubes were opened, the gaseous materials allowed to evaporate, and the unreacted telogen removed by distillation (maximum temperature of 150° C. at 0.2 torr) to yield a residue that was analyzed using $^{19}F$ NMR spectroscopy. The maxima in the spectrum indicated the presence of $CF_2I$ terminal groups originating from the telogen mainly, and from HFP and CTFE terminal units, indicated by maxima in the region from −50 to −60.4 ppm; CFI groups derived from HFP terminal units (−137 to −144 ppm); and CFClI groups from CTFE terminal units at −65.1 to −68 ppm. Internal units derived from CTFE were counted from the maxima in the range from −104 to −110 ppm, assigned to —CF2— units, as reported in Table 3.

The telomers were fluorinated as described in the following Example 17.

TABLE 3

Reactants (part by weight) and Products From Examples 15 and 16

| | Reactants | | | | | $I(A)(CTFE)_n(HFP)_mI$ | | |
|---|---|---|---|---|---|---|---|---|
| Example | $IC_2F_4I$ | $IC_4F_8I$ | CTFE | HFP | Residue* | A | n (avg.) | n/m |
| 15 | 17 | — | 5.2 | 7.5 | 5 | $C_2F_4$ | 3 | 21 |
| 16 | — | 16.8 | 4 | 22 | 4.15 | $C_4F_8$ | 4 | 9.5 |

*Residue remaining following distillation at a maximum temperature of 150° C. @ 0.2 torr

EXAMPLE 17

Telechelic Telomers Containing CTFE Units and Fluorination Thereof

A glass polymerization tube was charged with the telogen diiodotetrafluoroethane (32 parts weight) under inert atmosphere, following which 52 parts of CTFE were distilled in under reduced pressure.

The tube was then sealed and exposed for three days to the radiation from a 1000 watt Hanovia medium pressure mercury vapor lamp. At the end of this period the tube was opened, the gas allowed to evaporate and the telogen distilled at 150° C. under a pressure of 0.2 torr. The $^{19}F$ NMR spectrum of the residual telomer (15A) indicated the presence of terminal $CF_2I$ groups (−52 to −49 ppm), $CFCl_3$, —CFClI (−65 to −68 ppm). The proposed structure of the telomer based on this spectrum was $$I[(C_2F_4)(CTFE)_{6.4}]I \qquad (15A).$$

The telomer can be endcapped with hexafluoropropene using the procedure described in the preceding Example 5.

A sample of 3 parts of product (15A) was dissolved in sufficient Freon (R) 113 to form a 10% solution. A gas stream containing equal volumes of fluorine and nitrogen was bubbled through the solution for 4 hours. The $^{19}F$ NMR spectrum of the residue (70% yield) remaining following distillation of the solvent and of some low boiling telomer indicated that the CFClI group had been completely converted to $CF_2Cl$ (−65.1 to −65.5 ppm), and about 60% of the $CF_2I$ groups were converted to $CF_3$. The average chain length of the telomer was 8 CTFE units. The $^{19}F$ NMR spectrum of the telomer indicated that about 5% of adjacent units derived form CTFE were in a tail-to-tail configuration.

A longer fluoridation period was required to convert all of the $CF_2I$ terminal groups to $CF_3$ groups that exhibited maxima in the $^{19}F$ nmr spectrum in the range from −77 to −81 ppm.

That which is claimed is:

1. An unreactive, neutral and hydrogen-free cotelomer in the form of a liquid or a wax, said cotelomer consisting essentially of perfluorinated carbon atoms at the terminal positions and repeating units derived from chlorotrifluoroethylene and a member selected from the group consisting of (a) one perfluorinated olefin containing from two to six carbon atoms, (b) one perfluorinated alkylvinyl ether where the alkyl portion of said ether contains from one to six carbon atoms, c) one perfluorinated polyoxaalkylvinyl ether, wherein the said polyoxaalkyl portion of said ether contains from two to ten carbon atoms and from one to three oxygen atoms excluding the oxygen linking the vinyl radical of said ether, (d) mixtures of two perfluorinated olefins containing from two to six carbon atoms with the proviso that one of said two olefins is tetrafluoroethylene, and (e) mixtures of tetrafluoroethylene and one of said perfluorinated alkyl- or polyoxaalkyl vinyl ethers, where units derived from chlorotrifluoroethylene constitute up to 95 percent of the units present in said cotelomer and said cotelomer is substantially free of chlorine atoms located on adjacent carbon atoms.

2. The compound according to claim 1, wherein repeating units derived from chlorotrifluoroethylene constitute from 70 to 95 percent of the repeating units present in the cotelomer and the remaining units are selected from: 1) hexafluoropropene, 2) a perfluorinated methylvinylether, 3) perfluoro-2-methyl-3-oxahexyvinyl ether, 4) a combination of hexafluoropropene and tetrafluoroethylene, of 5) a combination of tetrafluoroethylene and perfluorinated methylvinyl ether.

3. A lubricant composition the compound of claim 1.

4. A hydraulic fluid comprising the compound of claim 1.

5. The grease ingredient comprising the compound of claim 1.

6. A method for preparing an unreactive, neutral and hydrogen-free liquid cotelomer compound, comprising the steps of:

A. forming a compound containing more than 50 weight percent of fluorine and consisting essentially of repeating units derived from chlorotrifluoroethylene and a member selected from the group consisting of (1) one perfluorinated olefin containing from 3 to 6 carbon atoms, (2) one perfluorinated alkylvinyl or polyoxaalkyl vinyl ether, wherein said alkyl radical contains from 1 to 6 carbon atoms and said polyoxaalkyl radical contains from 2 to 10 carbon atoms, and (3) mixtures of two perfluorinated olefins containing from 2 to 6 carbon atoms with the proviso that one of said olefins is tetrafluoroethylene, and (4) mixtures of tetrafluoroethylene and one of said perfluorinated alkylvinyl ethers; and B. forming a stabilized cotelomer by reacting a 5 to 30% by volume solution of the cotelomer in a liquid chlorofluorocarbon with a gas stream containing from 5 to 60 volume percent of fluorine diluted with nitrogen and maintaining said solution at a temperature of from −20° to +30° C. to form a solution said stabilized cotelomer, and C. isolating said stabilized cotelomer from said solution.

7. A method according to claim 6, where the process of stabilizing said cotelomer includes A. preheating said stabilized cotelomer (A) to a temperature of 135° C. prior to passing said stabilized cotelomer through a tube having a length/diameter ratio of 20 and filled with activated zinc scraps that are maintained at a temperature of from 100° to 150° C., the residence time of said cotelomer A in said tube being from 10 to 60 minutes to form cotelomer B, B. exhaustively fluorinating the cotelomer B by reacting it with a gas stream containing from 20 to 60 volume percent of fluorine diluted with nitrogen at temperatures from 50° to 175° C. in a nickel reactor and in the presence of $KCoF_4$ or $CoF_3$ as a filler while maintaining the temperature of the reaction mixture between 100° and 175° C., to form cotelomer C, and C. bubbling a stream of nitrogen through cotelomer C while maintaining said cotelomer C at a temperature of 50° C.

8. A method according to claim 6, wherein repeating units derived from chlorotrifluoroethylene constitute from 70 to 95 mole percent of the repeating units present in the cotelomer and the remaining units are selected from: 1) hexafluoropropene, 2) a perfluorinated methylvinylether, 3) perfluoro-2-methyl-3-oxahexylvinyl ether, 4) a combination of hexafluoropropene and tetrafluoroethylene, or 5) a combination of tetrafluoroethylene and perfluorinated methylvinyl ether.

* * * * *